US007121124B1

(12) United States Patent
Whinery

(10) Patent No.: US 7,121,124 B1
(45) Date of Patent: Oct. 17, 2006

(54) OVAL SWING LOCK MECHANISM

(76) Inventor: Christopher S. Whinery, 18690 U.S. Highway 64, Haskell, OK (US) 74436

( * ) Notice: Subject to any disclaimer, the term of this patent is extended or adjusted under 35 U.S.C. 154(b) by 0 days.

(21) Appl. No.: 11/271,336

(22) Filed: Nov. 12, 2005

(51) Int. Cl.
*E05B 67/22* (2006.01)

(52) U.S. Cl. ..... 70/38 C; 70/14; 70/25; 70/57; 244/224

(58) Field of Classification Search ..... 70/18, 70/19, 38 A–38 C, 233, 38 R, 14, 234–236, 70/53, 209, 51, 36–37, 15, 16, 2, 508, 302, 70/41–44, 399, 407, DIG. 6, 207, 367, 368
See application file for complete search history.

(56) References Cited

U.S. PATENT DOCUMENTS

| | | | | | |
|---|---|---|---|---|---|
| 596,237 | A | * | 12/1897 | Damon | 70/18 |
| 1,314,775 | A | * | 9/1919 | Wells | 70/25 |
| 1,477,777 | A | * | 12/1923 | Shek | 70/38 C |
| 1,516,081 | A | * | 11/1924 | Coykendall | 192/219.3 |
| 2,508,302 | A | * | 5/1950 | Stue | 70/19 |
| 3,792,884 | A | * | 2/1974 | Tutikawa | 292/37 |
| 4,028,916 | A | * | 6/1977 | Pender | 70/233 |
| 4,070,879 | A | * | 1/1978 | Thompson | 70/20 |
| 4,232,539 | A | | 11/1980 | Lo | |
| 4,719,773 | A | * | 1/1988 | Alberts | 70/18 |
| 5,211,041 | A | | 5/1993 | Hsu | |
| 5,505,064 | A | * | 4/1996 | Wang | 70/53 |
| 5,855,129 | A | * | 1/1999 | Warren et al. | 70/234 |
| 5,901,586 | A | * | 5/1999 | Hale | 70/18 |
| D430,787 | S | | 9/2000 | Liu | |
| 6,178,788 | B1 | * | 1/2001 | Winner | 70/38 C |
| D458,529 | S | * | 6/2002 | Vito | D8/331 |
| 6,536,246 | B1 | | 3/2003 | Wilson | |

* cited by examiner

*Primary Examiner*—Brian E. Glessner
*Assistant Examiner*—William Schrode

(57) ABSTRACT

A lock device allows for the secure attachment of two objects or a movable object to an immovable object, the device providing an oval base loop having a swivel slide collar on a first end and a fixed lock collar on a second end, the fixed lock collar having a keyed security lock means, and a pivotally attached lock loop having a first end slidably engaging the swivel slide collar and a second end having a tapered terminal tip slidably engaging the fixed lock collar and an inner margin having a plurality of inner spaced indentations which are engaged by the attachment between the keyed security lock means and the second end, the lock having an over-all oval shape when securely closed, the lock device adapted to secure two bicycle tires together, a steering wheel to a brake pedal, a steering wheel to a forward folded seat headrest, or other suitable application.

1 Claim, 4 Drawing Sheets

OVAL SWING LOCK MECHANISM

CROSS REFERENCE TO RELATED APPLICATIONS

None

I. BACKGROUND OF THE INVENTION

1. Field of Invention

A lock device allows for the secure attachment of two objects or a movable object to an immovable object, the device providing an oval base loop having a swivel slide collar on a first end and a fixed lock collar on a second end, the fixed lock collar having a keyed security lock means, and a pivotally attached lock loop having a first end slidably engaging the swivel slide collar and a second end having a tapered terminal tip slidably engaging the fixed lock collar and an inner margin having a plurality of inner spaced indentations which are engaged by the attachment between the keyed security lock means and the second end, the lock having an over-all oval shape when securely closed, the lock device adapted to secure two bicycle tires together, a steering wheel to a brake pedal, a steering wheel to a forward folded seat headrest, or other suitable application.

2. Description of Prior Art

The following United States patents were discovered and are disclosed within this application for utility patent. All relate to locks having some oval component or other similar features, although none having the same elements or components as the present secure lock device.

In U.S. Pat. No. 4,232,539 to Lo, a keyed lock device is disclosed having a rotatable keyed lock engaging a cylindrical bar.

An automobile steering wheel lock having another keyed lock mechanism is disclosed in U.S. Pat. No. 5,211,041 to Hsu.

U.S. Pat. No. 6,5369,246 to Wilson discloses a lock device having an extendable arm which is slidably engaged with an opening having an internal rachet means and a releasable leg engaging a second opening retaining the releasable leg within the second opening by a turnable combination lock.

U.S. Design Pat. No. D430,787 to Liu shows a bicycle lock having a half oval arm securing to a locking bar.

None of the above disclosed patents, either alone or in combination comprise the essential elements of the present lock device.

II. SUMMARY OF THE INVENTION

Many applications requiring a lock device are presented which would best be provided by a lock device having a locking loop configuration. Locking two bicycle wheels together to prohibit any rotation has been addressed by cable locks and other flexible lock devices, but some tire rotation is generally presented. The same device would not provide suitable security for the attachment of a steering wheel to a headrest or to attach a steering wheel to a brake pedal. A need for a multiple application lock which may be constricted for locking objects together at a fixed distance is something not fully addressed by prior art.

The primary objective of the invention is to provide a lock device having two oval sections which may be locked together in a reduced and fixed radius. A secondary objective would be to provide the lock device with a locking loop to be pivotally engaged with base loop, forming an overall oval shape when secured, but having the locking loop swing or pivot around the base loop during the engagement of the lock device to the object being secured.

III. DESCRIPTION OF THE DRAWINGS

The following drawings are submitted with this utility patent application.

FIG. 6 is a front view of the lock device in an open position with the split swivel slide collar in the second position and with the lock loop pivoted out and away from the base loop.

IV. DESCRIPTION OF THE PREFERRED EMBODIMENT

Figure 1:
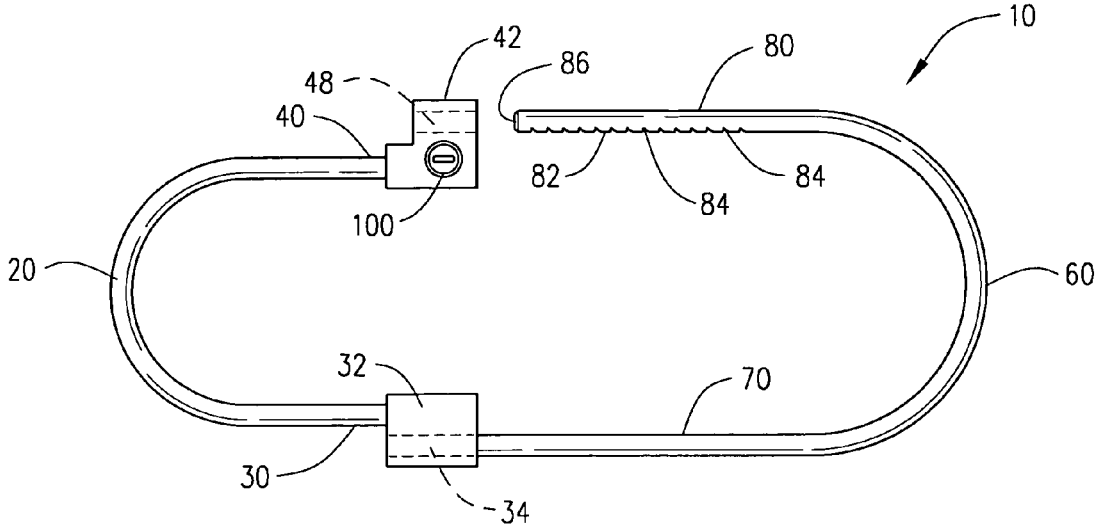
FIG. 1 is a front view of the lock device in an open and unsecured position.
Figure 2:
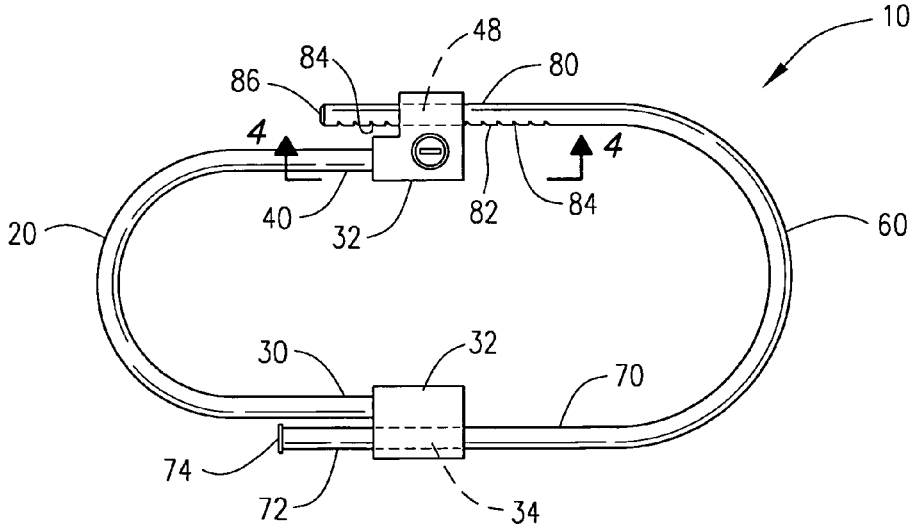
FIG. 2 is a front view of the lock device in a closed and secured position
Figure 3:
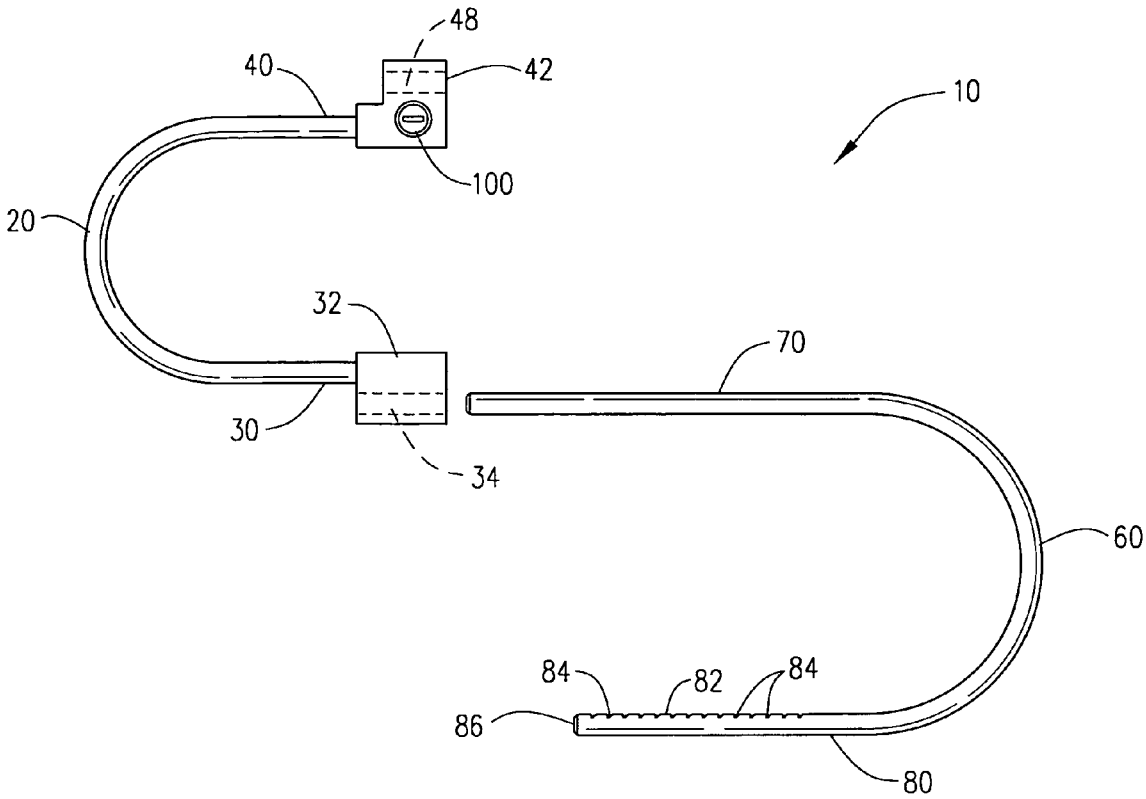
FIG. 3 is a front view of the lock device in an open position with the lock loop pivoted out and away from the base loop.

A lock device 10 for securing two objects together, shown in FIGS. 1–6 of the drawings, comprises an oval base loop 20 having a first end 30 attached to a swivel slide collar 32 and a second end 40 attached to a fixed lock collar 42 having a keyed security locking means 100, the swivel slide collar 32 having a cylindrical slide channel 34 with a flared end cap recess 35, and the fixed lock collar 42 having a cylindrical locking channel 48 integrating with the keyed security locking means 100 and an oval lock loop 60 having a first leg 70 pivotally and slidably engaging the cylindrical slide channel 34, FIG. 3, the first leg 70 having a first terminal end 72 having a flared end cap 74 to prevent full disengagement of the first leg 70 from the cylindrical slide channel 34, and a second leg 80 having an inner margin 82 containing a plurality of spaced indentations 84, said second leg 80 having a second tapered terminal end 86 removably engaging the cylindrical locking channel 48 but being secured within the cylindrical locking channel 48 when the keyed security locking means 100 is engaged with at least one of the plurality of spaced indentations 84 on the inner margin 82 of the second leg 80, the oval lock loop 60 being compressed against the oval base loop 20 until the objects being attached are secured, after which the keyed security locking means 100 is engaged to secure the second leg 80 within the fixed lock collar 42 until the keyed security locking means 100 is disengaged. The lock device may also include an embodiment without the first terminal end 72 having a flared end cap 35 which would allow the oval lock loop 60 to become completely disengaged from the swivel slide collar 32, if preferred.

Figure 4:
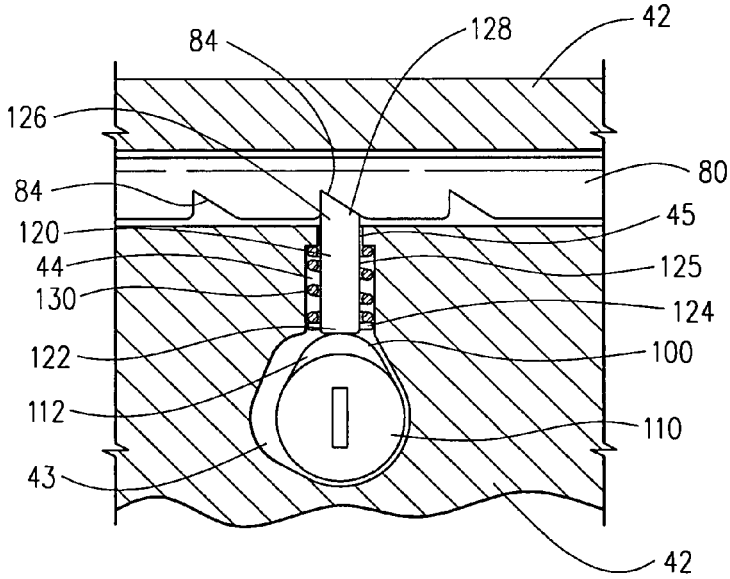
FIG. 4 is a cross-sectional view along section lines 4/4 of FIG. 2, illustrating the locking means engaged with one of the plurality of the spaced indentation of the inner margin of the second end of the locking loop.

The keyed security locking means 100 may be more specifically disclosed as shown in FIG. 4, wherein the keyed security locking means 100 further comprises a rotatable keyed locking cylinder 110 set within a lock cavity 43 within the fixed lock collar 42, the locking cylinder 110 having a lower extension 112 projecting outward from the lock cylinder 110, and a spring biased lock tang 120 which is set within a tang cavity 44 having a tooth slot aperture 45 integrating into the cylindrical locking channel 48 within the fixed locking collar 42, the spring biased lock tang 120 having an upper portion 122 with a spring retaining cap 124, a neck 125 upon which a coil spring 130 is set, the coil spring 130 captured between the spring retaining cap 124 and the tooth slot aperture 45, and a lower portion 126 forming a chiseled tip 128, wherein the keyed locking cylinder 110 is rotated forcing the lower extension 112 into the upper portion 122 of the spring biased locking tang 120, urging the chiseled tip 128 into the cylindrical locking channel 48, the chiseled tip 128 engaging one of the plurality of spaced indentations 84 in the inner margin 82 of the second leg 80 of the oval lock loop 60, securing the lock device 10 in a locked position, FIG. 2. The keyed security locking means may also be provided as a keyless lock, although not shown in any of the drawing figures.

Figure 5A:
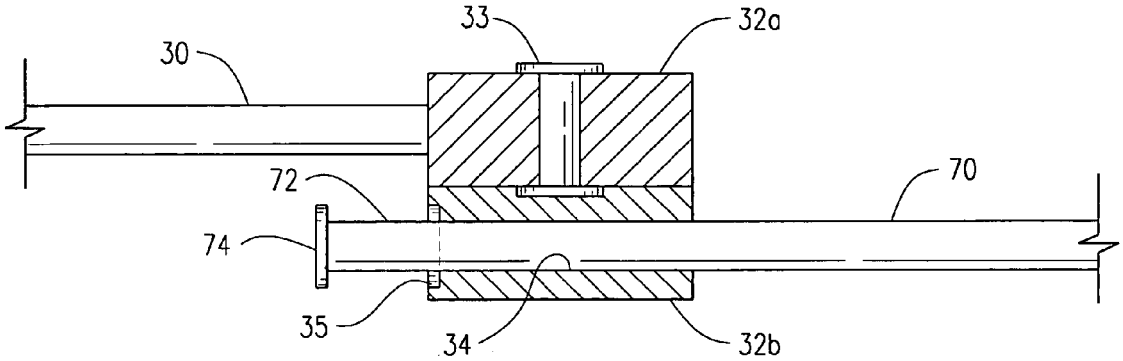
FIG. 5A is a cross-sectional view of a split swivel slide collar in a first position.
Figure 5B:
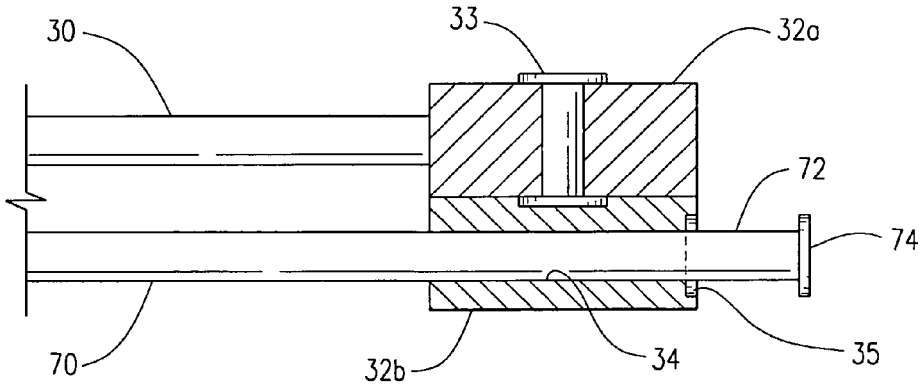
FIG. 5B is a cross-sectional view of the split swivel slide collar in a second position.
Figure 5:
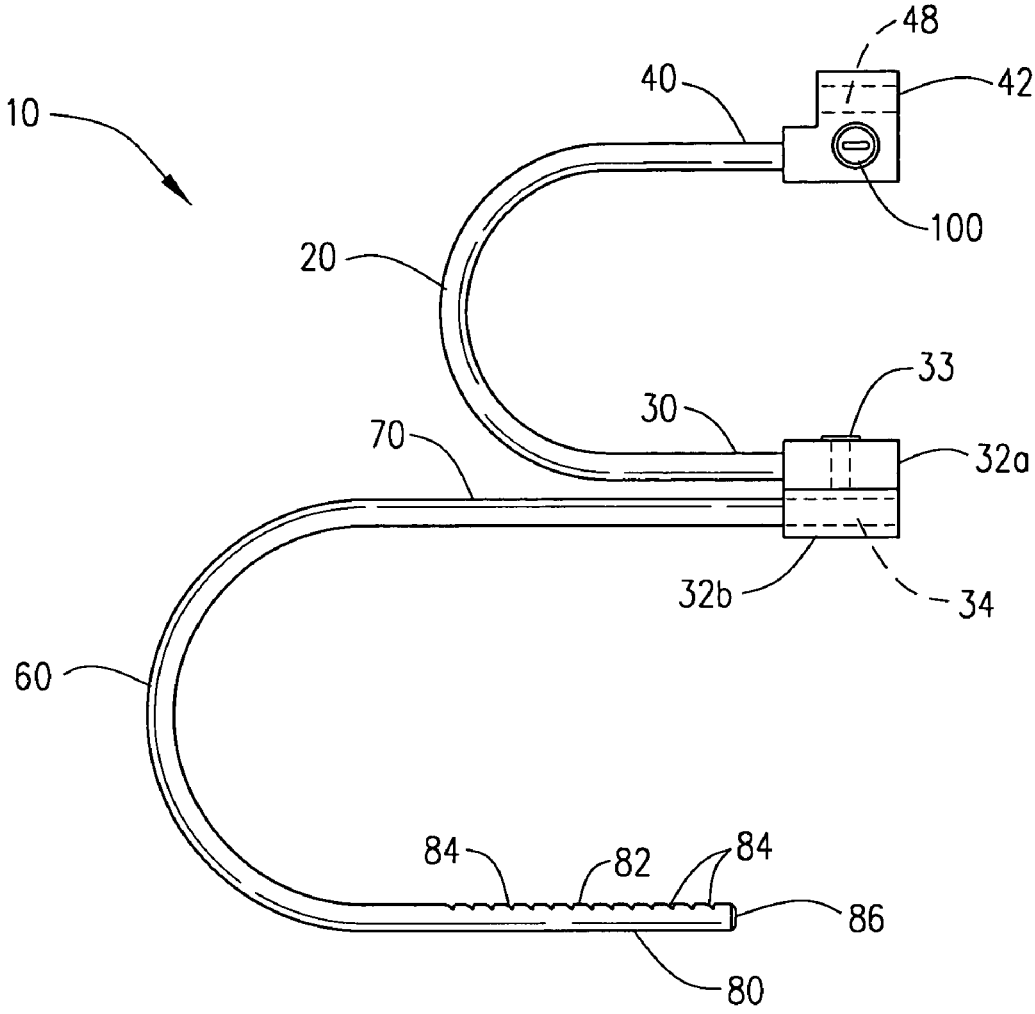

A second embodiment of the lock device may be provided by the swivel slide collar having an upper half 32*a* and lower half 32*b*, pivotally joined by a split swivel slide collar pivot pin 33, allowing the upper and lower halves 32*a*, 32*b*, of the swivel slide collar 32 to be axially rotated into a locking position, FIG. 5A and a released and open position, FIG. 5B, which provide the lock device 10 in a W-shaped device, FIG. 6. The swivel slide collar 32 may also be provided with a hinge between the upper and lower halves 32*a*, 32*b*, although not shown in any of the drawing figures.

The lock device 10 would most preferably made of a hardened metal and may be adapted in size and over-all shape for use in place of a padlock for a locker or tool box, may be used to secure two wheels of a bicycle into a fixed position, may secure a portable object to a fixed object, and may even be adapted for use to secure a steering wheel to a brake pedal or another object in the vehicle. It may also be preferred, although not shown in any drawing figures, that portions of the lock device 10 may be coated with a padded foam material to protect the objects being secured from friction damage potentially caused by the application or removal of the lock device 10.

While the invention has been particularly shown and described with reference to a preferred embodiment thereof, it will be understood by those skilled in the art that changes in form and detail may be made therein without departing from the spirit and scope of the invention.

What is claimed is:

1. A lock device securing two or more objects together comprising: an oval base loop and an oval lock loop, said oval base loop having a first end attached to a swivel slide collar and a second end attached to a fixed lock collar having a keyed security locking means, said swivel slide collar having a cylindrical slide channel with a flared end cap recess and having an upper half and lower half pivotally joined by a split swivel slide collar pivot pin defining an axis, allowing said upper and lower halves of said swivel slide collar to be axially rotated into a locking position and a released position, wherein the oval base loop and he oval lock loop are in an open W-shaped position and said fixed lock collar having a cylindrical locking channel integrating with said keyed security locking means; and an oval lock loop having a first leg pivotally and slidably engaging said cylindrical slide channel, said first leg further defining a first terminal end having a flared end cap to prevent 111 disengagement of said first leg from said cylindrical slide channel, and a second leg having an inner margin containing a plurality of spaced indentations, said second leg further defining a second tapered terminal end removably engaging said cylindrical locking channel yet secured within said cylindrical locking channel when said keyed security locking means is engaged with at least one of said plurality of spaced indentations on said inner margin of said second leg, wherein said first and second legs of said oval lock loop are compressed with said respective cylindrical slide channel and said cylindrical locking channel towards said oval base loop until a desired position is obtained and said keyed security locking means is engaged to secure said second leg within said fixed lock collar until said keyed security locking means is disengaged.

* * * * *